US005509835A

United States Patent [19]

Henderson et al.

[11] Patent Number: 5,509,835

[45] Date of Patent: Apr. 23, 1996

[54] TROLLING MOTOR QUICK-STOWAGE DEVICE

[75] Inventors: William A. Henderson, Starkville; Lynn E. Cook, III, Columbus, both of Miss.; Stephen P. Malak, Tulsa, Okla.

[73] Assignee: Zebco Corporation, Tulsa, Okla.

[21] Appl. No.: 285,854

[22] Filed: Aug. 4, 1994

[51] Int. Cl.[6] ..... B63H 5/12

[52] U.S. Cl. ..... 440/63; 440/6

[58] Field of Search ..... 440/6, 53, 54, 440/63; 24/270, 273; 248/640, 642, 316.2, 231.3

[56] References Cited

U.S. PATENT DOCUMENTS

| | | | |
|---|---|---|---|
| 2,584,955 | 2/1952 | Williams | 248/231.3 |
| 3,016,225 | 1/1962 | Hughes et al. | 248/231.3 |
| 3,724,790 | 4/1973 | Harris et al. . | |
| 3,861,628 | 1/1975 | Krieger . | |
| 3,954,080 | 5/1976 | Weaver . | |
| 4,410,161 | 10/1983 | Booty . | |
| 4,555,233 | 11/1985 | Klammer et al. | 440/53 |
| 4,634,390 | 1/1987 | Baird . | |
| 4,735,166 | 4/1988 | Dimalanta | 440/6 |
| 4,966,566 | 10/1990 | Baird . | |

*Primary Examiner*—Jesús D. Sotelo
*Attorney, Agent, or Firm*—Rosenblatt & Redano

[57] ABSTRACT

A stowage device is provided which allows a trolling motor to be longitudinally raised and held in place. The stowage device has a collar, such as a U-bolt, which fits around the trolling motor shaft. The closed end of the collar is rigidly attached to a supporting structure, such as a boat hull or an attachment to the hull. A cam is rotatably attached to the collar so that it can engage the trolling motor shaft. A handle attached to the cam allows the fisherman to control the rotational position of the cam. The trolling motor shaft is inserted between the closed end of the collar and the cam. With the cam in the unlocked position, the trolling motor shaft is free to move and the trolling motor may be positioned anywhere between its two end positions. In its first end position, the trolling motor propeller is in the water, and in its second end position, the trolling motor propeller is out of the water. For normal trolling use, the trolling motor propeller will be in the water. To hold the trolling motor free of the water, the motor is raised to the desired position and the cam is operable to lock the trolling motor in the desired position.

12 Claims, 3 Drawing Sheets

TROLLING MOTOR QUICK-STOWAGE DEVICE

FIELD OF THE INVENTION

This invention relates to devices for use in quickly stowing trolling motors used by fishermen.

BACKGROUND OF THE INVENTION

Fishermen often have more than one motor on their fishing boats. A large motor may be used for moving the boat between distant points on a body of water such as a lake. A much smaller, trolling motor is used to troll in the immediate vicinity of a chosen fishing spot. During times when the larger motor is in operation, the fisherman must retract the trolling motor from the water. On arriving at a chosen location, the fisherman must then reset the trolling motor to its useful position. Often, these operations must be carried out repeatedly during a day's fishing.

Various devices have been introduced to make the task of retracting and resetting the trolling motor less onerous. The available devices allow the fisherman to retract the trolling motor from the water and stow the motor in a horizontal position on the boat.

U.S. Pat. No. 3,724,790 to Harris et al. discloses a motor mounting assembly to attach a trolling motor to a boat. The assembly allows the motor to be pivoted up and out of the water to a stowed horizontal position on the deck.

U.S. Pat. No. 3,861,628 to Krieger discloses a bracket assembly which allows a fisherman to mount a trolling motor so that it can be automatically positioned vertically for operation in the water, and retracted when not in use. In the retracted position, the trolling motor is on top of the boat deck in a horizontal position.

U.S. Pat. No. 3,954,080 to Weaver discloses a bracket and linkage assembly for mounting a trolling motor to the bow or deck of a boat. Once attached, the motor may be swung between its vertical operating position and its stowed position on the deck.

U.S. Pat. Nos. 4,634,390 and 4,966,566 to Baird disclose spring-biased mechanisms which are pivotally attachable to a trolling motor mount. These mechanisms are used to counterbalance the weight of a trolling motor to aid the fisherman in raising the trolling motor out of the water to stow it in a horizontal position on the deck.

U.S. Pat. No. 4,410,161 to Booty discloses a mounting apparatus for trolling motors which utilizes a mounting bracket and swivel arms to allow the motor to be rotated through 90° from an operation (vertical) position to a stowed (horizontal) position.

The above-listed devices allow the fisherman to stow a trolling motor by bringing the motor to a horizontal position on the boat. However, none of these devices allow the fisherman to quickly raise the trolling motor from the water, hold it in an approximately vertical position, and then quickly lower it into an operational position. Additionally, the devices listed above require substantial hardware to accomplish their goal of allowing the trolling motor to be pivoted up out of the water and stowed in a locked position on the boat deck.

It is an object of the present invention to allow a fisherman to quickly raise a trolling motor from the water so that he can then motor to another location without having to stow the trolling motor in a horizontal position.

It is another object of the present invention to allow a fisherman to quickly and easily lower a trolling motor into the water without having to release the motor from a stowed horizontal position.

It is a further object of the present invention to allow a trolling motor to be secured in a raised vertical position so that it is unnecessary to move the motor to a horizontal stowed position.

SUMMARY OF THE INVENTION

A stowage device is provided which allows a trolling motor to be vertically raised and releasably locked in place. The stowage device has a collar, such as a U-shaped collar, which fits around the trolling motor shaft. The closed end of the collar is rigidly attached to a supporting structure, such as a boat hull or an attachment to the hull. A cam is positioned rotatably attached to the collar so that it rotates about an axis perpendicular to the inner faces of the U-collar. A handle attached to the cam allows the fisherman to control the rotational position of the cam. The trolling motor shaft is inserted between the closed end of the collar and the cam. With the cam in the unlocked position, the trolling motor shaft is free to move, and the trolling motor may be releasably positioned anywhere between its two end positions. In its first end position, the trolling motor propeller is in the water, and in its second end position, the trolling motor propeller is out of the water.

For normal trolling use, the trolling motor propeller will be in the water. To hold the trolling motor free of the water, the motor is raised to the desired position and the handle is used to rotate the cam into the locked position. With the cam in the locked position, the trolling motor shaft is securely held between the closed end of the collar and the cam.

In another embodiment of this invention, the cam is provided with teeth along its outer surface. In this configuration, the fisherman can raise the motor and lock it into position by lifting the motor itself. As the motor is raised, the cam rotates due to the frictional contact between the motor shaft and the teeth. Once the motor has been raised to the desired position, the motor may be released and the motor shaft will be held in position by the weight of the motor. In this embodiment, the fisherman is not required to force the cam into a locked position.

Further objects and features of the present invention will be apparent to those skilled in the art from the following detailed description of preferred embodiments, taken together with the accompanying drawings.

DETAILED DESCRIPTION OF THE PREFERRED EMBODIMENT

Figure 1B:
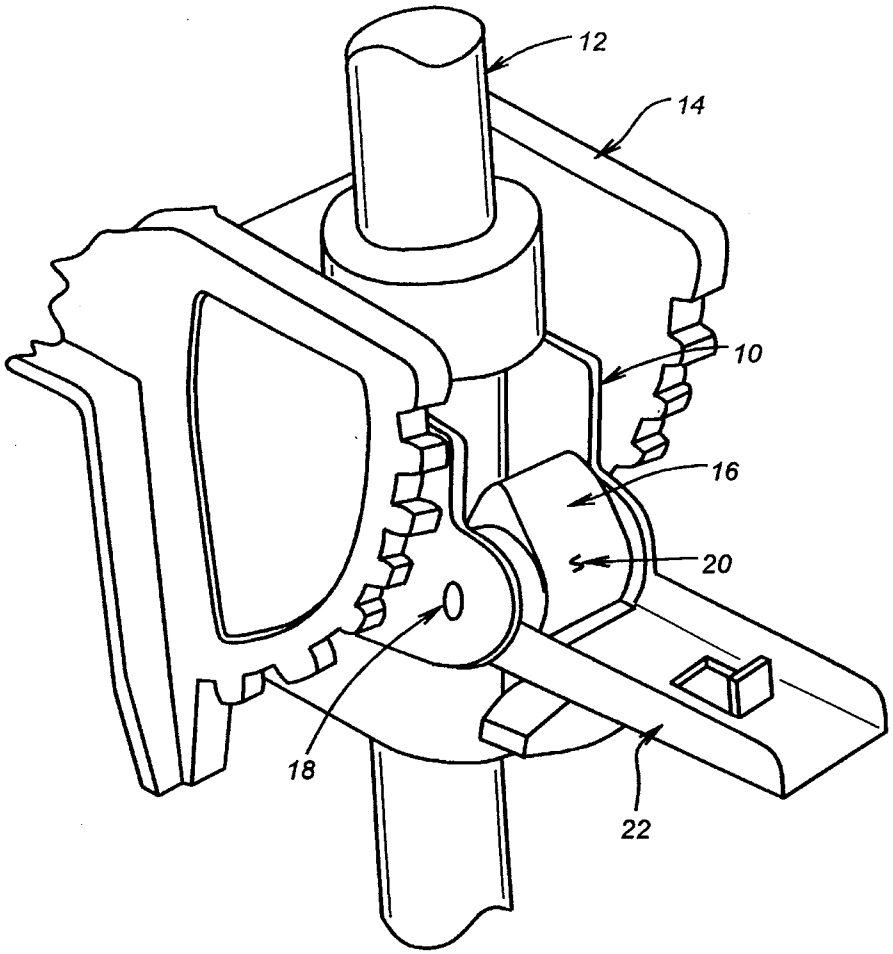
FIG. 1B shows the device in the unlocked position.
Figure 1A:
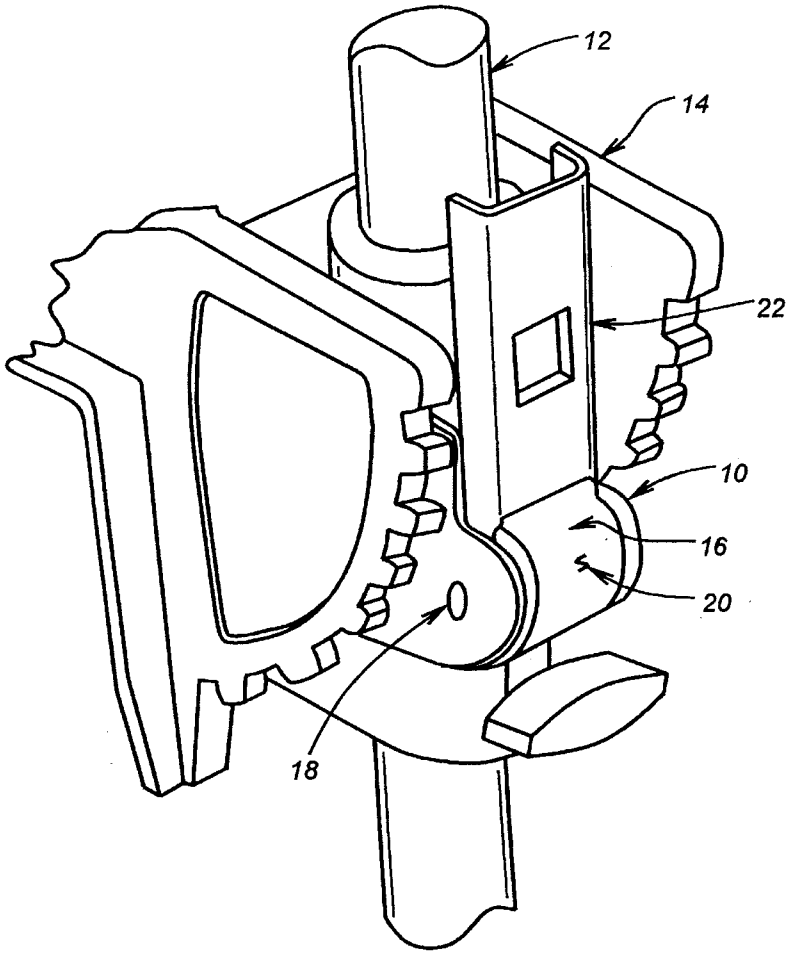
FIG. 1A shows the device in the locked position.

Referring to FIGS. 1A–B, one embodiment of the device is shown in which a collar 10 fits around the trolling motor shaft 12. The collar 10 fits within and is mountable to the transom mount 14. A cam 16 preferably made from an elastomeric material is rotatably attached to the collar 10 in an overcenter configuration by an axial pin 18. Axial pin 18 is rotatably attached to the collar 10, and the cam 16 is fixed to the axial pin 18 by spiral pin 20. The handle 22 is also rigidly attached to the axial pin 18, so that the cam 16 and the handle 22 maintain a fixed position relative to each other. When the handle 22 is rotated, the overcenter configuration causes the cam to be biased into the locked position, as shown in FIG. 1A. The trolling motor shaft 12 is longitudinally immobilized because it is pressed between the collar 10 and the cam 16. This occurs because in the preferred embodiment, the centerline of cam 16 is offset from pivot axis 18. This configuration ensures that when the cam 16 is rotated in a given direction, there is a bias force acting on the cam 16 to bias it into a locked or unlocked position. When the handle 22 is rotated to the unlocked position, as shown in FIG. 1B, the trolling motor shaft 12 may be moved between its end positions. The handle 22 may be rotated by hand into the locked position to secure the trolling motor vertically when the trolling motor is positioned at or anywhere between its end positions.

Figure 2A:
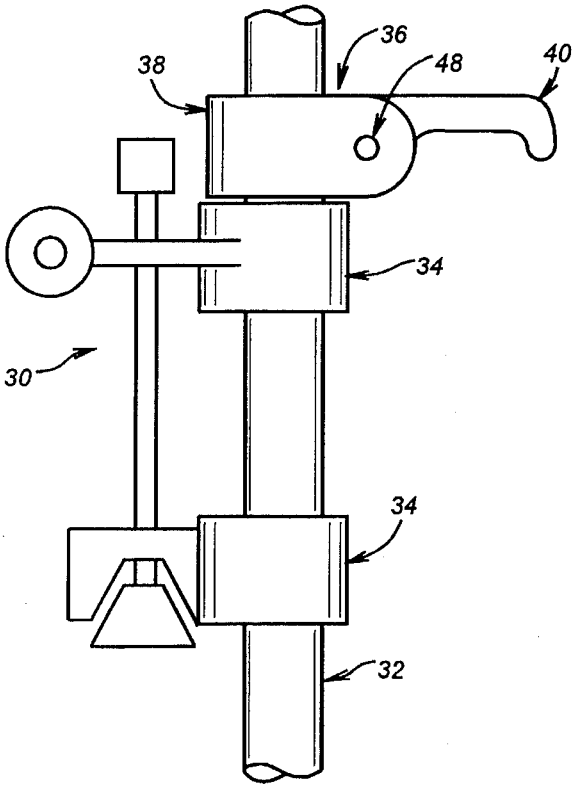
FIG. 2A shows a side view of the device in the unlocked position.
Figure 2B:
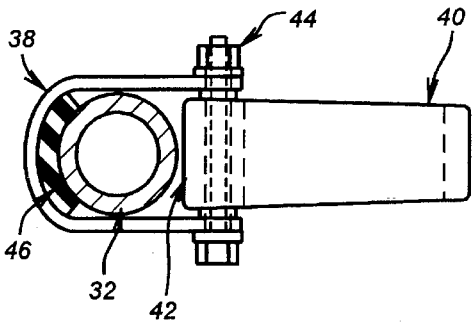
FIG. 2B shows a cross-sectional top view of the device in the unlocked position.
Figure 2C:
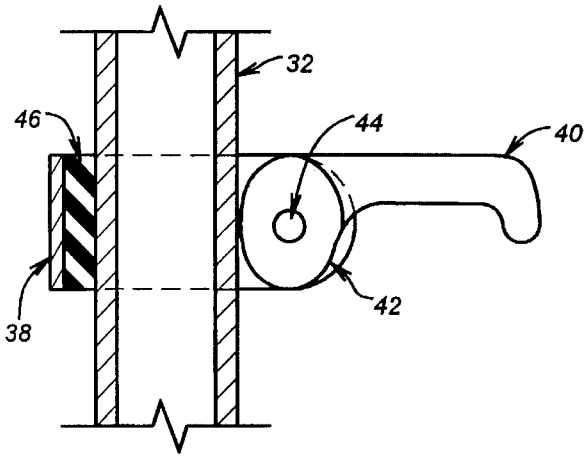
FIG. 2C shows a cut-away side view of the device in the unlocked position.
Figure 2D:
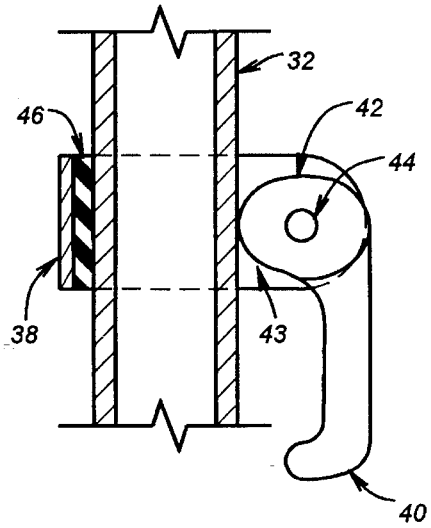
FIG. 2D shows a cut-away side view of the device in the locked position.

Referring to FIGS. 2A–D, another embodiment of the device is shown. The trolling motor is secured to the boat by a mounting unit 30, as shown in FIG. 2A. The trolling motor shaft 32 is slidably inserted through the mounting brackets 34. The locking device 36 rests on top of the upper mounting bracket 34. The device comprises a collar, such as a U-shaped collar 38, which fits around the trolling motor shaft 32. A handle 40 is an extension from a cam 42, having its larger end located at 43. The handle 40 and cam 42 are rotatably attached to the collar 38 by a pin 44. A piece of compressible material 46, such as rubber, is fixed to the inside of the collar 38. When the handle 40 is rotated to the unlocked position, as shown in FIGS. 2A, 2B, and 2C, the trolling motor shaft 32 may be moved between its end positions. When the handle 40 is rotated into the locked position, as shown in FIG. 2D, the larger end 43 of cam 42 pulls the collar 38 and compresses material 46. The trolling motor shaft 32 is then immobilized. The handle 40 may be rotated by hand into the locked position to secure the trolling motor when the trolling motor is positioned at or anywhere between its end positions.

Figure 3A:
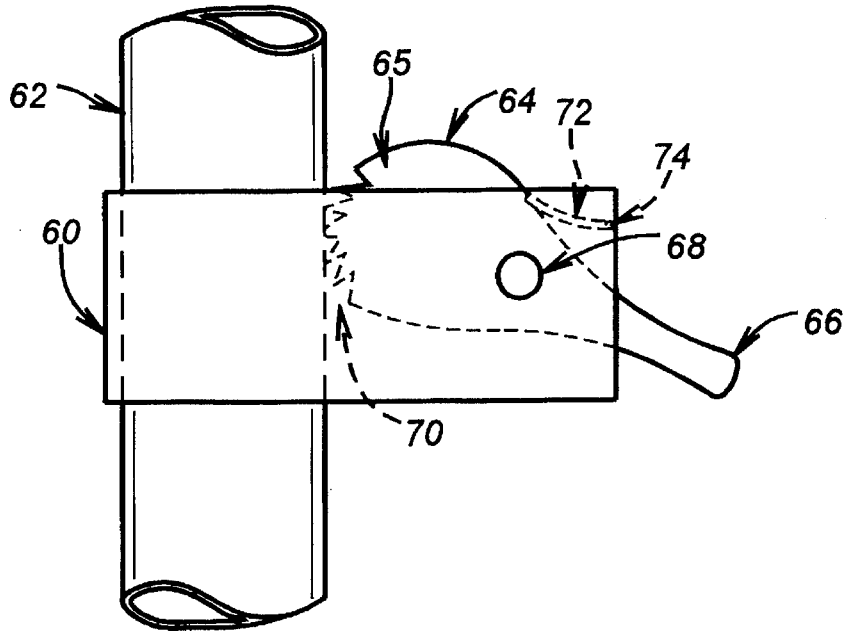
FIG. 3A shows a cut-away side view of the device in the locked position.
Figure 3B:
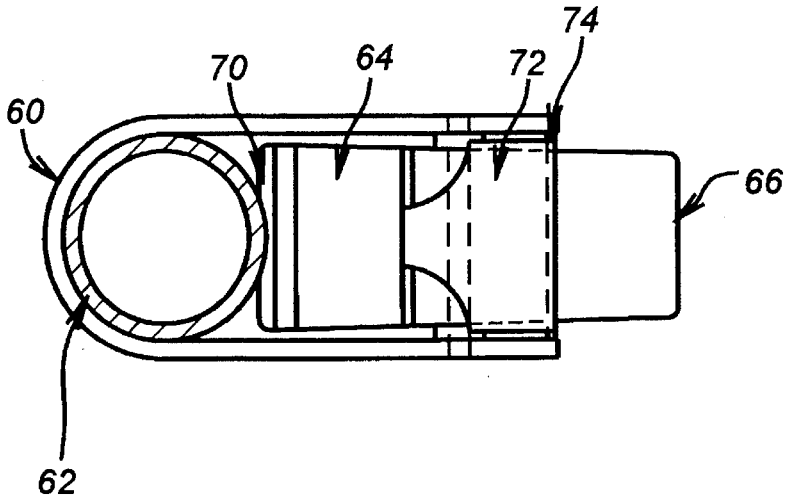
FIG. 3B shows a cross-sectional top view of the device in the locked position.

A third embodiment of the device is shown in FIGS. 3A–B. A U-shaped collar 60 fits around the trolling motor shaft 62. A cam 64 has an extension handle 66 for the operator's use. The cam 64 and the handle 66 are rotatably attached to the collar 60 by a pin 68. The edge of the cam 64 has a larger end 65. Cam 64 has formed teeth 70 providing a frictional fit with the trolling motor shaft 62. The cam teeth 70 are flexible to facilitate a wedging action. Other means of selectively wedging or retaining the shaft 62 against a collar 60 are also within the scope of the invention.

Referring to FIG. 3A, pulling the trolling motor shaft 62 up causes the cam 64 to rotate clockwise about the pin 68, permitting the shaft 62 to be vertically moved. Releasing the upward pull on the trolling motor shaft 62 causes the weight of shaft 62 to force shaft 62 down to engage the formed teeth 70 to thereby grip the trolling motor shaft 62 and lock it in place. The trolling motor shaft 62 is locked in place by the weight of the trolling motor, so that it is not necessary for the operator to force the cam 64 into a locked state. The trolling motor shaft 62 can be released by pressing downward on the handle 66 to rotate the cam 64. A means of applying force to the cam 64, such as a leaf spring 72, biases the cam 64 into contact with the trolling motor shaft 62 when the downward pressure on the handle 66 is released. The leaf spring is mounted to the collar 60 by a pin 74.

Many modifications and variations may be made in the embodiments described herein and depicted in the accompanying drawings without departing from the concept of the present invention. Accordingly, it is understood that the embodiments described and illustrated herein are illustrative only and are not intended as a limitation upon the scope of this invention.

We claim:

1. A device for releasably locking a trolling motor in a desired position, comprising:

means for supporting a trolling motor, wherein the trolling motor may be selectively moved in a direction substantially along its longitudinal axis at or between a first end position and a second end position, such that in the first end position, the trolling motor propeller is in the water and in the second end position, the trolling motor propeller is out of the water; and means for selectively securing the trolling motor to said means for support;

wherein said means for selectively securing the trolling motor comprises a cam which is mounted to a frame for selectively locking the trolling motor to said frame.

2. The device of claim 1, wherein said cam is pivotally mounted to said frame such that the weight of a trolling motor, when in contact with said cam, biases the cam into a wedging action with the trolling motor for its support.

3. The device of claim 2, wherein said cam is constructed of an elastomeric material.

4. The device of claim 2, wherein said cam comprises formed teeth and wherein said formed teeth are flexible.

5. A device for releasably locking a trolling motor in a desired position, comprising:

means for supporting a trolling motor, wherein the trolling motor may be selectively moved in a direction substantially along its longitudinal axis at or between a first end position and a second end position, such that in the first end position, the trolling motor propeller is in the water and in the second end position, the trolling motor propeller is out of the water; and means for selectively securing the trolling motor to said means for support;

wherein said means for selectively securing the trolling motor comprises a cam which is mounted to a frame for selectively locking the trolling motor to said frame;

wherein said cam is pivotally mounted to said frame such that the weight of a trolling motor when in contact with said cam biases the cam into a wedging action with the trolling motor for its support; and wherein said means for securing the trolling motor also comprises a means of applying force to said cam to force the cam into contact with the trolling motor shaft.

6. The device of claim 5, wherein said means for applying force to the cam device comprises a spring.

7. The device of claim 5, wherein said means for applying force to the cam device comprises a leaf spring.

8. A method of securing a trolling motor vertically, comprising the steps of:

providing a support for the trolling motor;

allowing the trolling motor to be substantially longitudinally moved to and between a first end position and a second end position, such that in the first end position, the trolling motor propeller is in the water and in the second end position, the trolling motor propeller is out of the water;

releasably securing the trolling motor at or between said first or second end positions;

positioning the trolling motor with the trolling motor shaft inserted between the closed end of a collar and a cam; and rotating the cam so that the pressure applied to the trolling motor shaft by the closed end of the collar and by the cam secures the trolling motor shaft against longitudinal movement.

9. A method of securing a trolling motor vertically comprising the steps of:

supporting a trolling motor;

allowing the trolling motor to be substantially longitudinally moved to and between a first end position and a second end position, such that in the first end position, the trolling motor propeller is in the water and in the second end position, the trolling motor propeller is out of the water;

releasably securing the trolling motor at or between said first or second end positions;

positioning the trolling motor with the trolling motor shaft inserted between the closed end of a collar and a cam such that the cam is in frictional contact with the trolling motor shaft;

moving the trolling motor vertically until the trolling motor is in the desired position;

releasing the trolling motor; and using the trolling motor weight to urge the cam to retain the trolling motor shaft to said collar.

10. The method of claim 9, further comprising the step of:

pivoting said cam so that said shaft can be lifted without significant cam resistance, but upon release of said lifting force, the trolling motor weight urges said cam into retaining said shaft against said collar.

11. A trolling motor support apparatus for a boat for selectively retaining a trolling motor by its shaft, comprising:

a support bracket mounted to the boat and guiding the shaft of the trolling motor for selective longitudinal movement;

a clamp circumscribing, at least in part, said shaft;

said clamp further comprising a lock mechanism selectively operable for engagement with the shaft in a first position, whereupon the weight of said shaft is transferred to said clamp which in turn is supported by said bracket, and a second position where said shaft is substantially longitudinally movable through said clamp for repositioning said shaft;

said clamp selectively rests on said bracket for support of said shaft but is not rigidly secured thereto; and said lock mechanism further comprises a cam operated by a lever for selectively securing the shaft to said clamp.

12. A trolling motor support apparatus for a boat for selectively retaining a trolling motor by its shaft comprising:

a support bracket mounted to the boat and guiding the shaft of the trolling motor for selective substantially longitudinal movement;

a clamp circumscribing, at least in part, said shaft;

said clamp further comprising a lock mechanism selectively operable for engagement with the shaft in a first position whereupon the weight of said shaft is transferred to said clamp which in turn is supported by said bracket, and a second position where said shaft is substantially longitudinally movable through said clamp for repositioning said shaft;

said clamp selectively rests on said bracket for support of said shaft but is not rigidly secured thereto;

said lock mechanism further comprises a cam operated by a lever for selectively securing the shaft to said clamp; and said cam is pivotally mounted in said clamp in such a position as to readily permit lifting the shaft out of the water but to facilitate wedging against the shaft if not deliberately swung back when the lifting force on the shaft is removed.

* * * * *